US005604570A

United States Patent [19]

Jeran et al.

[11] Patent Number: 5,604,570

[45] Date of Patent: Feb. 18, 1997

[54] ELECTROPHOTOGRAPHIC PRINTER WITH APPARATUS FOR MOVING A FLEXIBLE PHOTOCONDUCTOR INTO ENGAGEMENT WITH A DEVELOPER MODULE

[75] Inventors: Paul L. Jeran, Meridian; David J. Arcaro, Boise; David S. Pitou, Meridan, all of Id.

[73] Assignee: Hewlett-Packard Company, Palo Alto, Calif.

[21] Appl. No.: 269,310

[22] Filed: Jun. 30, 1994

[51] Int. Cl.[6] ..... G03G 5/00; G03G 15/06; G03G 15/10

[52] U.S. Cl. ..... 399/116; 399/213; 399/162

[58] Field of Search ..... 355/200, 210, 355/211, 212, 245, 326 R, 259, 256, 327, 273; 347/154, 140, 158; 118/645, 661

[56] References Cited

U.S. PATENT DOCUMENTS

| | | | |
|---|---|---|---|
| 3,880,518 | 4/1975 | Chatfield | 355/245 X |
| 4,189,223 | 2/1980 | Silverberg | 355/200 |
| 4,206,994 | 6/1980 | Silverberg et al. | 355/212 |
| 4,279,496 | 7/1981 | Silverberg | 355/212 |
| 4,630,919 | 12/1986 | Fantuzzo et al. | 355/212 X |
| 4,797,703 | 1/1989 | Guslits | 355/212 |
| 4,806,991 | 2/1989 | Guslits | 355/212 |
| 5,063,411 | 11/1991 | Haneda et al. | 355/212 |
| 5,189,472 | 2/1993 | Haneda et al. | 355/212 |
| 5,394,232 | 2/1995 | Tamura et al. | 355/256 X |
| 5,519,474 | 5/1996 | Arcaro et al. | 355/256 |

FOREIGN PATENT DOCUMENTS 60-164778 8/1985 Japan .

*Primary Examiner*—Shuk Y. Lee

[57] ABSTRACT

A latent image is developed in the photoconductor surface of a moving belt by displacing the belt from its path of movement toward an adjacent stationary electrophotographic developer as the latent image approaches that developer, to establish a toner transfer gap therebetween, where toner is transferred from the developer to the photoconductor as the latent image passes the developer. Electromagnetically or pneumatically operated mechanisms are employed to displace the belt.

16 Claims, 3 Drawing Sheets

ELECTROPHOTOGRAPHIC PRINTER WITH APPARATUS FOR MOVING A FLEXIBLE PHOTOCONDUCTOR INTO ENGAGEMENT WITH A DEVELOPER MODULE

RELATED APPLICATION

U.S. Pat. No. 5,519,474 for a "Pneumatic Delivery System For Liquid Toner Hard Copy Apparatus" by David Arcaro et al, (assigned to the common assignee of the present invention), filed May 24, 1994 and incorporated herein by reference in its entirety.

BACKGROUND OF THE INVENTION

1. Field of the Invention

The present invention relates generally to electrophotography, more particularly to color, hard copy printing and plotting, and, more specifically, to a liquid toner developer actuation system for a color hard copy apparatus.

2. Description of the Related Art

In electrophotographic printing an electrostatic latent image in a photoconductor is developed by applying toner to the latent image. Contact of the toner developed image with paper transfers the toner to the paper to create a hard copy reproduction of the image. In further detail, a charge is applied to a photoconductive insulating surface area of a photoconductor. The surface area is exposed to a pattern of light. By this exposure a latent image of the pattern is formed in the charged photoconductor surface. The latent image is then developed by the application of electroscopic toner to the photoconductive material. The toner of the developed image is transferred by contact to a hard copy sheet, usually a paper medium and fused, or fixed, thereto. The photoconductor surface is then cleaned removing the image and reused for the next image. This basic construct is used in a variety of state of the art products such as computer printers and plotters, copiers, facsimile machines, and the like.

In the field of color hard copy reproduction, such as by laser printers using liquid electrophotography (LEP) techniques, the use of color liquid toners (generally yellow, magenta, cyan (the subtractive primary colors), and black) present challenging implementation problems. One such problem is in the developer mechanism of the hard copy apparatus where color toner is transferred from a reservoir in a developer mechanism or module, to a photoconductor, in order to develop the latent image. After a photosensitized material is exposed to a pattern of illumination, a latent image of that pattern exists in the distribution of dissipated electrical charges on the surface of the material. The electrostatic latent image is developed by the attraction of toner to the latent image at the developer module (of a type dependent upon the type of toner employed, liquid or dry powder; e.g., air nozzles, brushes, rollers, or the like).

In a development cycle as practiced in the prior art, the development module is brought into toner transfer position with the photoconductor in order to initiate the image development process. This involves moving the developer assembly into contact with the photoconductor at the location of the latent image. Since the entire mass of the developer assembly must be moved, this requires a motor and precision guidance hardware. In addition, if any parts of the developer assembly are driven from a common gear train then the gear train must allow for this motion. Further there is no simple mechanism to vary the time duration of developer assembly proximity with the photoconductor for developing the latent image. This adds additional complexity and cost to the developer design.

Therefore, there is a need for an improved, low cost, latent image developer actuation system for hard copy producing machines.

SUMMARY OF THE INVENTION

This invention provides a new approach to the application of toner to the electrostatic latent image in a photoconductor, which is cost effective in reducing the complexity of the implementation and in reducing the power requirement, in the latent image development process.

It is an advantage of the present invention that it provides a unique low cost developer actuation system for an electrophotographic hard copy machine.

It is an advantage of the present invention that it provides for the variation of the time of toner transfer between the developer assembly and the latent image in the photoconductor.

It is still another advantage of the present invention that it provides a compact developer actuation system, allowing reduction of machine size.

It is yet another advantage of the present invention that it can be implemented in a replaceable cartridge form.

It is a further advantage of the present invention that it has fewer and less expensive components and, thus, a lower cost of manufacture.

This invention takes advantage of the flexibility of a photoconductor belt which provides a mechanism which displaces the belt to place the photoconductor surface of the belt into toner transfer position with a stationary developer assembly, instead of moving the developer assembly to the photoconductor. A photoconductor belt is wrapped around two rollers with a belt tensioning mechanism provided to remove any slack in the belt. When image development is to be initiated for a given color, the web of the belt is displaced to the developer assembly to place the latent image in the photoconductor surface in a position for the latent image development process to begin. A precise toner transfer position of the photoconductor belt with a toner transfer mechanism at the developer assembly is established and maintained for optimal latent image development to occur. This toner transfer position is also referred to herein as a "functional proximity relationship" between the photoconductor surface on the belt and the developer assembly. When the latent image development process is concluded, the photoconductor surface of the belt is removed from toner transfer proximity with the toner transfer mechanism of the developer assembly, causing the latent image development by toner transfer to cease. The mechanics for implementing latent image development are simplified and the power requirement is reduced, resulting in reduced printer cost and a more reliable printing system.

The invention is implemented in one of its aspects as a photoconductor belt cartridge which is insertable and removable from a electrophotographic apparatus.

Other objects, features and advantages of the present invention will become apparent upon consideration of the following detailed description and the accompanying drawings.

DETAILED DESCRIPTION OF THE INVENTION

Figure 1:
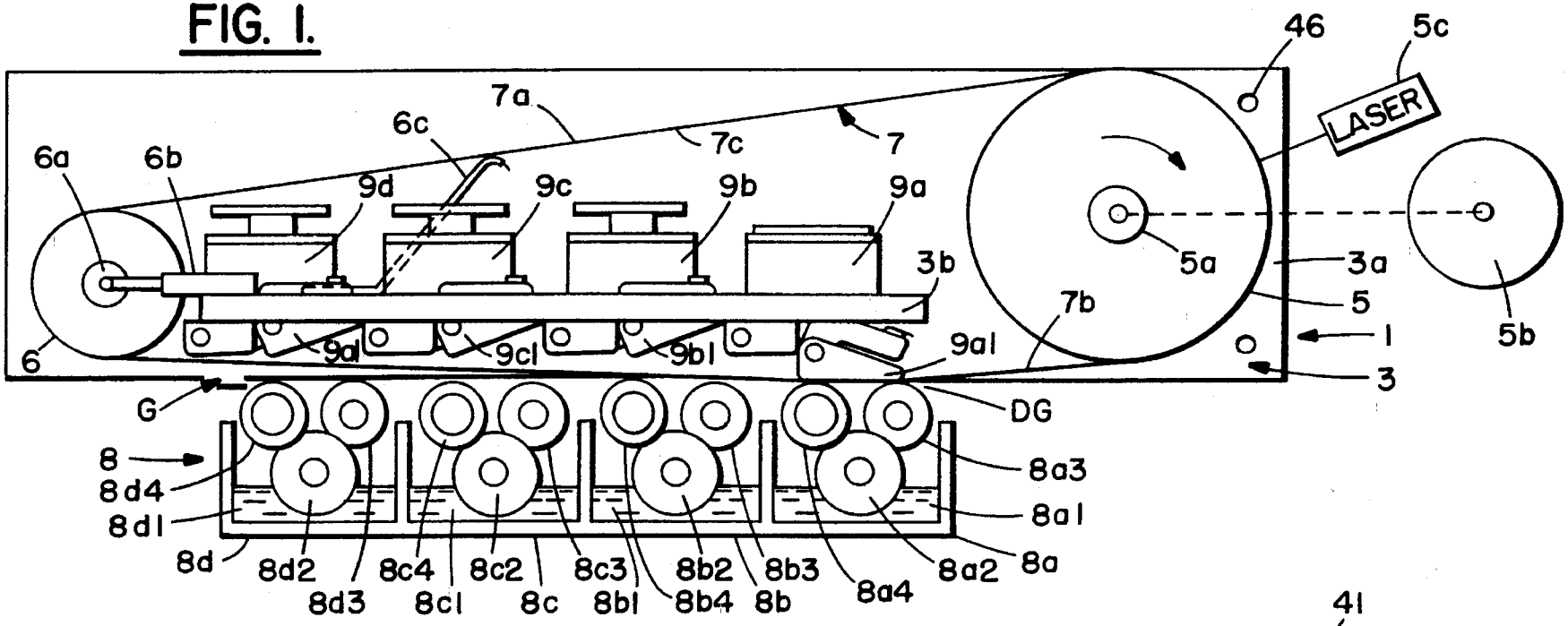
FIGS. 1 and 1A illustrate a first embodiment of an electrophotographic image development apparatus in which a flexible, photoconductor belt is moved into toner transfer position with the electrophotographic developer.

A first embodiment of this invention is illustrated in the side elevational view of FIG. 1 which illustrates an apparatus for the initiation of the development of a latent image on a photoconductor surface of a flexible photoconductor member in a liquid electrophotographic process. The apparatus comprises a photoconductor belt cartridge 1 which is an integrated unit comprising a cartridge frame 3 which mounts a pair of pulleys or rollers 5 and 6 over which a flexible photoconductor belt 7, having a photoconductor surface 7*a*, is entrained.

The cartridge frame 3 comprises a pair of substantially identical side frames 3*a*, only one of which is shown to permit the illustration of internal structure. The side frames 3*a* are joined as an integrated frame structure by a base plate 3*b*. The pulleys or rollers 5 and 6 are journalled between the side frames 3*a* at opposite ends of the side frames, respectively, on respective shafts 5*a* and 6*a*. Roller 5 is the power roller and is driven by a motor 5*b*, shown only schematically. The power roller 5 is rotated clockwise as viewed, to move the lower section 7*b* of the belt 7 from right to left past a photoconductor developer assembly 8 comprising one or more electrophotographic developers 8*a*–8*d*. The base plate 3*b* which is located between the lower and upper sections 7*b*, 7*c* of the belt 7 mounts a solenoid assembly 9 comprising a plurality of individual solenoid actuators 9*a*–9*d* for actuating respective platens 9*a*1–9*d*1, there being one solenoid actuator for each photographic developer 8*a*–8*d*. Each platen 9*a*1–9*d*1, as seen at platen 9*a*1, is displaced downwardly by the associated solenoid actuator, 9*a*–9*d*, to engage and to displace downwardly the lower section 7*b* of the belt 7 thereat. Displacement is controllable to establish a functional transfer of toner from the electrophotographic developer 8*a* at that location, as will be explained. Belt tensioning, if needed, is provided by a spring loaded compression strut 6*b* between the base plate 3*b* and the shaft 6*a* at the idler pulley 6, or, alternatively, by a leaf spring tensioner 6*c* mounted to the base plate 3*b*, and having a distal end in sliding or rolling contact with the inner surface 7*c* of the belt 7, as seen in dot-dash outline.

The electrophotographic developers 8, for toner colors yellow, cyan, magenta and black, respectively, each comprise a chamber, 8*a*1–8*d*1, containing toner, a toner transporting roller 8*a*2–8*d*2, for transporting toner to a developer roller 8*a*3–8*d*3 and a squeegee roller 8*a*4–8*d*4 for removing excess toner from the photoconductor surface 7*a* of the belt as the toner development image moves therepast and returning the excess toner to the toner transport roller 8*a*2–8*d*2.

The electrophotographic developer assembly 8 is located beneath the photoconductor belt cartridge 1 in a position spacing the developer rollers 8*a*3–8*d*3 and squeegee rollers 8*a*4–8*d*4 from the photoconductive surface 7*a* at the bottom section 7*b* of the belt 7 by a gap G. This gap G separates the belt and the electrophotographic developer assembly 8 sufficiently to obviate toner transfer to the photoconductor surface of the belt when the belt is moving but there is no belt displacement.

Figure 1A:
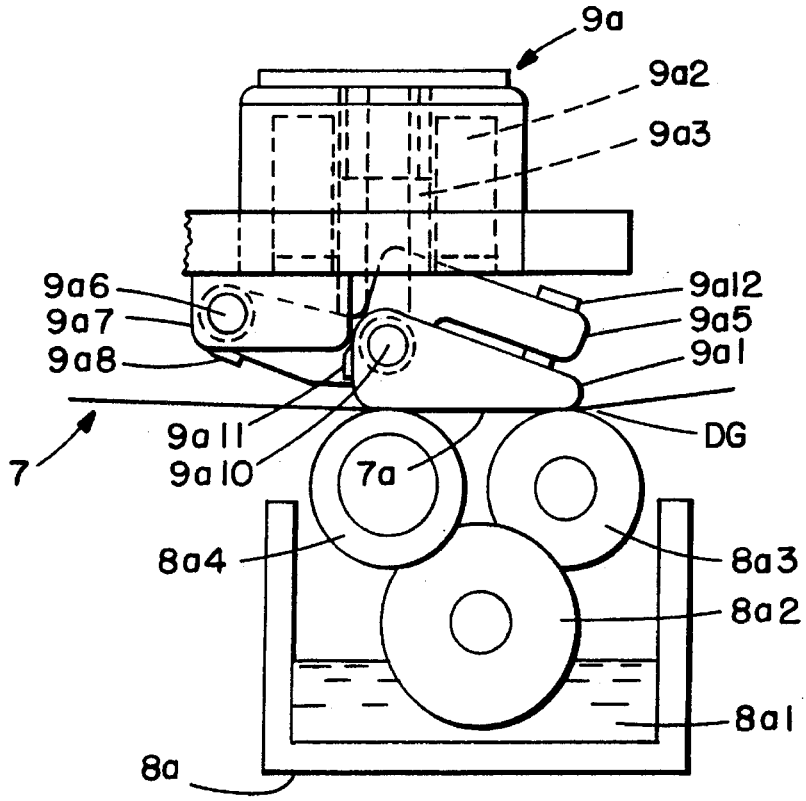

A description of the solenoid actuator 9*a*, as seen in FIG. 1A, will suffice for all actuators. The solenoid actuator 9*a* comprises a solenoid coil 9*a*2 and a plunger 9*a*3. The solenoid plunger 9*a*3 presses directly on platen 9*a*1. Pivot link 9*a*5 to which platen 9*a*1 is attached, is pivotly mounted on a pivot shaft 9*a*6 in a pivot block 9*a*7 fixedly secured to the bottom side of the base plate 3*b* of the cartridge frame 3. A torsion spring 9*a*8 on the pivot shaft 9*a*6 biases the pivot link 9*a*5 counterclockwise to retract the platen 9*a*1. The platen 9*a*1, pivotally mounted to the pivot link 9*a*5 by a pivot shaft 9*a*10 is biased by a torsion spring 9*a*11 in a counterclockwise direction about the pivot shaft 9*a* 10 to engage its distal end with the end of a developer gap adjusting screw 9*a*12. The stroke of the solenoid plunger 9*a*3 is limited within the solenoid to control belt displacement so that the heel of the platen 9*a*1 displaces the photoconductor surface 7*a* of the belt 7 into contact with the squeegee roller 8*a*4. The development gap DG, which is too small to see in the drawing, between the photoconductor surface 7*a* of the belt 7 and the developer roller 8*a*3, located at the distal end of the platen 9*a*1, is adjusted by the developer gap adjusting screw 9*a*12.

A latent image projection source 5*c* having a light source such as a laser, traces an image, establishing a latent image, in the photoconductor 7*a* on the belt 7, as the charged belt passes the laser source. The charging source is not shown in the interest of drawing simplicity. Assuming the latent image requires the application of the color of the liquid color toner contained in the electrophotographic developer 8*a*, when the latent image approaches that location, the solenoid 9*a* is energized. The platen 9*a*1 displaces the belt, engaging the photoconductor surface 7*a* of the belt with the squeegee roller 8*a*4 and establishing the developer gap DG at which toner transfer to the moving latent image in the photoconductor surface takes place, thereby developing that latent image. Excess toner is removed from the photoconductor and the developed image by the squeegee roller 8*a*4.

Where the latent image to be developed requires more than one color, a new latent image for each color, configured for the specific color, is traced on the pre-charged photoconductor surface 7*a* by the laser source 5*c*. These latent images, as is known, are traced successively and developed successively in successive circulations of the photoconductor belt 7. The location of the respective latent images on the photoconductor belt 7, provides registration of the images of different colors on the recirculating hard copy printout of the electrophotographic apparatus, as is also well known. When each new laser image approaches the electrophotographic developer, 8*b*–8*d*, for the color required by that image, the corresponding solenoid 9*b*–9*d* is energized. The platen 9*b*1–9*d*1 displaces the belt 7 so that the selected color toner transfer to the latent image for that color takes place and the squeegee roller 8*b*4–8*d*4 removes the excess toner.

The invention, as disclosed herein, contemplates the use of a liquid toner which is transported by the transport roller, 8*a*2–8*d*2, to the developer roller, 8*a*3–8*d*3. Powdered toner may be used also.

While a specific solenoid actuated linkage has been described, it will be appreciated that any solenoid actuated linkage which employs a platen to achieve belt displacement which places the photoconductor surface *7a* in contact with the squeegee roller and provides the developer gap DG for achieving toner transfer, may be employed.

Reference is made now to FIGS. 2–5 which illustrate a second embodiment of the present invention, which illustrates the best mode presently contemplated by the inventors for practicing the invention. Alternative embodiments are also briefly described as applicable. In the commercial embodiment of the present invention, the system disclosed can be economically self-contained within a housing, such as a replaceable photoconductor cartridge for a laser printer, to effectuate simple repair. Various housings can be designed with form and function for any particular electrophotography application in which it is to be employed. As such, a specific exemplary housing design shown in the drawings is not intended as any limitation on the implementation or the scope of the invention.

Figure 2:
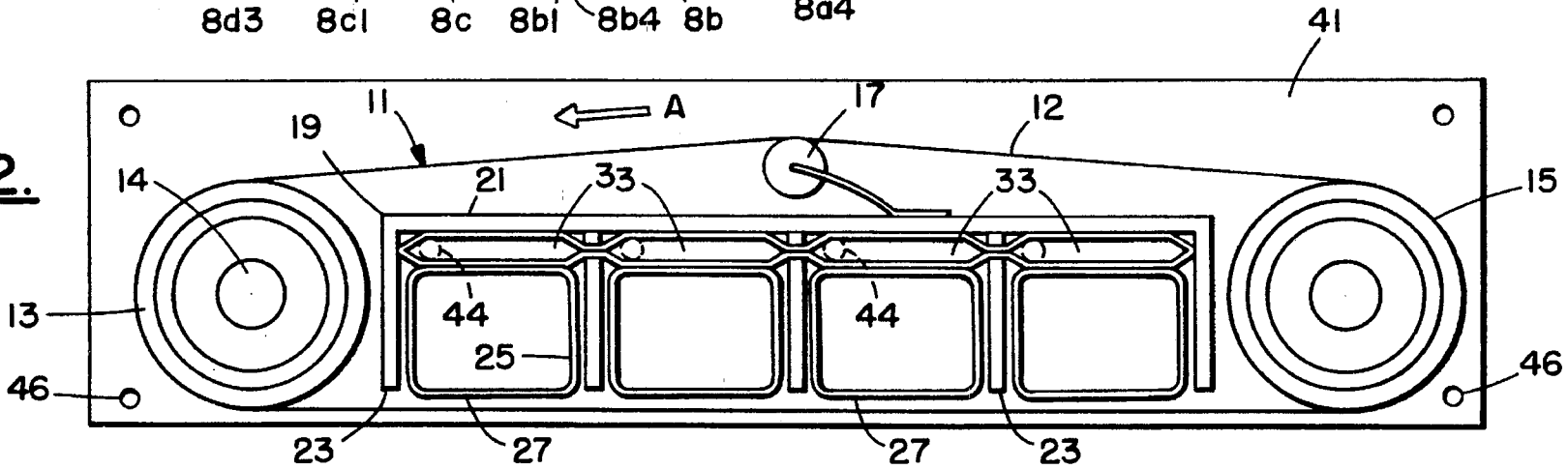
FIG. 2 illustrates a second embodiment of an electrophotographic image development apparatus in which a flexible, photoconductor belt is moved into toner transfer position with the electrophotographic developer.

Referring now to FIG. 2, a photoconductor belt 11 has a photoconductor surface 12 in the form of a relatively thin photoconductor layer 12. The photoconductor belt 11 is wrapped about two friction drive rollers, 13, 15. At least one of the friction drive rollers 13 is coupled to a mechanical power drive device, such as the motor **5*b*, as seen in FIG. 1, that supplies torque to the friction drive roller 13 in order to move the photoconductor belt 11 as indicted by arrow "A." For example, the drive device can be a simple, constant speed, DC motor, 5*b*, FIG. 1, which may be a part of the electrophotography apparatus. The motor shaft mechanically couples to the shaft 14 of the friction drive roller 13 as the belt cartridge is inserted into the electrophotographic apparatus. The other roller 15** may be a follower or idler roller.

The width and length of the photoconductor belt 11 and the nature of the photoconductive surface is dependent upon the electrophotographic apparatus to which the system is adapted, specifically designed to provide appropriate image transfer to the media type and size (letter, legal, envelope, or the like) used in the hard copy production.

An optional tensioner 17 is provided for setting the photoconductor 11 to a predetermined tension or for adjusting the belt tension to an appropriate friction drive roller tension. One or more such tensioners 17 can be provided for a particular commercial embodiment. Alternatively, the roller 15, not coupled to the motor, may have a spring biased mounting of the type of FIG. 1, acting as a spring loaded idler pulley.

Within the loop formed by the photoconductor belt 11 is a belt shifting or displacing means mounted adjacent the photoconductor belt 11 for shifting a predetermined portion of the photoconductor belt 11, as the latent image moves therepast, from its path of motion, into functional proximity with a developer mechanism thereat, such as the developer mechanism 8 of FIG. 1. This shifting mechanism is operated by a simple pressurized means. The shifting mechanism comprises guiding means such as a guide housing 19. The guide housing 19 has a base plate 21 and guide plates 23, extending approximately perpendicularly to the base plate 21. The exact geometrical shape, size and functional directionality of the guide housing 19 may be designed in accordance with the requirements of a particular electrophotographic apparatus to which the invention is adapted.

A displacable platen means comprises a platen support member 25, generally a bar of plastic or aluminum, having a width slightly greater than the width of the photoconductor belt 11 and having a platen face 27, is adapted to fit slidingly between the guide plates 23. Each pair of guide plates 23 thus forms a U-shaped guide for each platen support member 25.

Figure 3A:
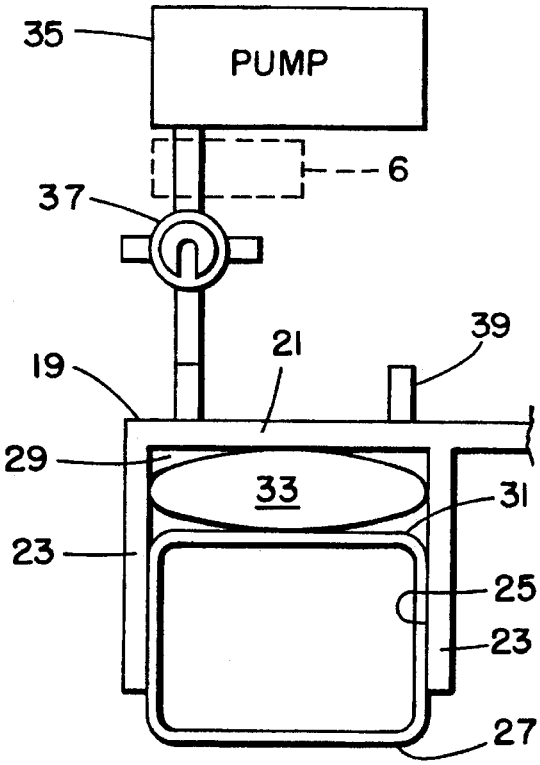
FIGS. 3A and 3B illustrate a belt displacing mechanism according to one embodiment of this invention, in operative and inoperative positions, respectively.

Referring briefly to FIG. 3A, in this configuration a space is formed between a facing region 29 of the base plate 21, at the turn of the U-shaped guide, and a top face 31 of each platen support member 25, between each pair of depending guide plates 23. Referring back to FIG. 2, within each space a pressurizing means such as a selectively inflatable bladder 33 (or bellows, or other suitable balloon-type device) is positioned. Each bladder 33 is substantially the same width and length at the top face 31 of its adjoining platen support member 25.

In an alternative embodiment, a flex member, or members, (not shown) may be mounted connecting base plate 21 to each platen support member 25 so as to retain the platen support member 25 at a retracted position. The more costly U-shaped guide may thus be eliminated.

Each bladder 33 is capable of being selectively pressurized and de-pressurized. It has been found that a simple diaphragm air pump, providing a range of one to five pounds per square inch ("PSI"), is sufficient to provide enough pressure to drive the system. When the present invention is housed in a replaceable cartridge form, the air pump can be attached by a hose running to a simple fitting or fittings in the cartridge which is then connected to pressurize selectively each bladder 33.

Each bladder 33, generally formed of polyethylene, polyvinylchloride, or the like, for example, can be made using two sheets of flexible, air-tight plastic. The bladders 33 are affixed on most of one side to an adjacent face 29 of the base plate 21 by a suitable adhesive. Moreover, by affixing most of the other side of a bladder 33 to the top face 31 of its adjacent platen support member 25, the bladder 33 itself can hold the platen support member 25 in the above said sliding fit between the depending guide plates 23. Adhering the bladders 33 while inflated ensures that sufficient unadhered material is maintained to prevent damage during inflation-deflation cycles. As shown in FIG. 2, multiple bladders 33 can be integrally formed in conjunction with the guide housing 19.

Figure 3B:
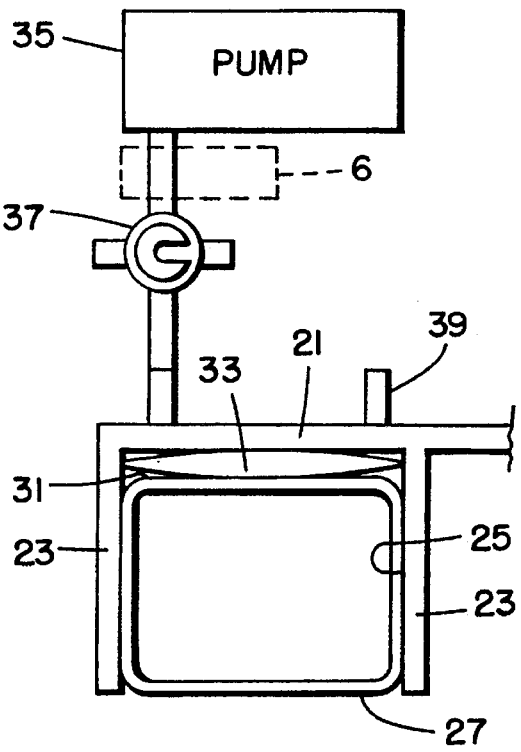

As shown in FIGS. 3A and 3B, a charge of a gas, such as air, from the pump 35 can be directed to a particular bladder by use of a four-way rotary valve 37. A controllable manifold (not shown) may be substituted for such a valve. In order to improve the system timing, an accumulator 6, seen in dotted outline, connected between the pump 35 and the valve 37, or manifold, may be optionally provided. The gas charge inflates the bladder and moves the platen support to extend the platen 27 against the photoconductor belt 11.

The bladder 33 is deflated to retract the platen 27 from contact with the photoconductor 11. In order to hasten the collapse of a bladder 33, an optional bias member (not shown), such as at least one coil spring (or in the above mentioned alternative embodiment, the flex member), can be attached between the top face 31 of the platen support member 25 and the opposing face 29 of the base plate 21. Thus, the bladder can deflate, under pressure from the tensioned photoconductor belt itself, such a bias member, or by a vacuum drawn on the bladder. The gas charge goes back into the hose connecting the pump 35 to the bladder 33 (or the optional accumulator) or through an escape vent 39 that can be opened during the depressurization stage of operation.

The invention, as a replaceable unit, is depicted in its assembled form in FIG. 2. Here, a holding means comprises two mounting plates, only the rear mounting plate 41, being shown which are designed to adapt the developer actuation system to a particular hard copy apparatus. Provision is made for mounting the developer actuation system into a hard copy machine such as by providing appropriate apertures 46 through which mounting bolts (not shown) can be inserted. Such mounting may be designed in accordance with the particular hard copy machine to which the present invention is adapted.

Apertures 44, seen in FIG. 2, providing an air inlet and outlet for the bladders 33, extend through one mounting plate 41. Commercially available hose couplings or simple interference friction fittings suffice to connect the bladders 33 to the diaphragm pump 35 or rotary valve 37. The previously discussed connection for the drive roller shaft 14 of friction roller 13 is also provided in a design suited to the hard copy apparatus of interest.

Figure 4:
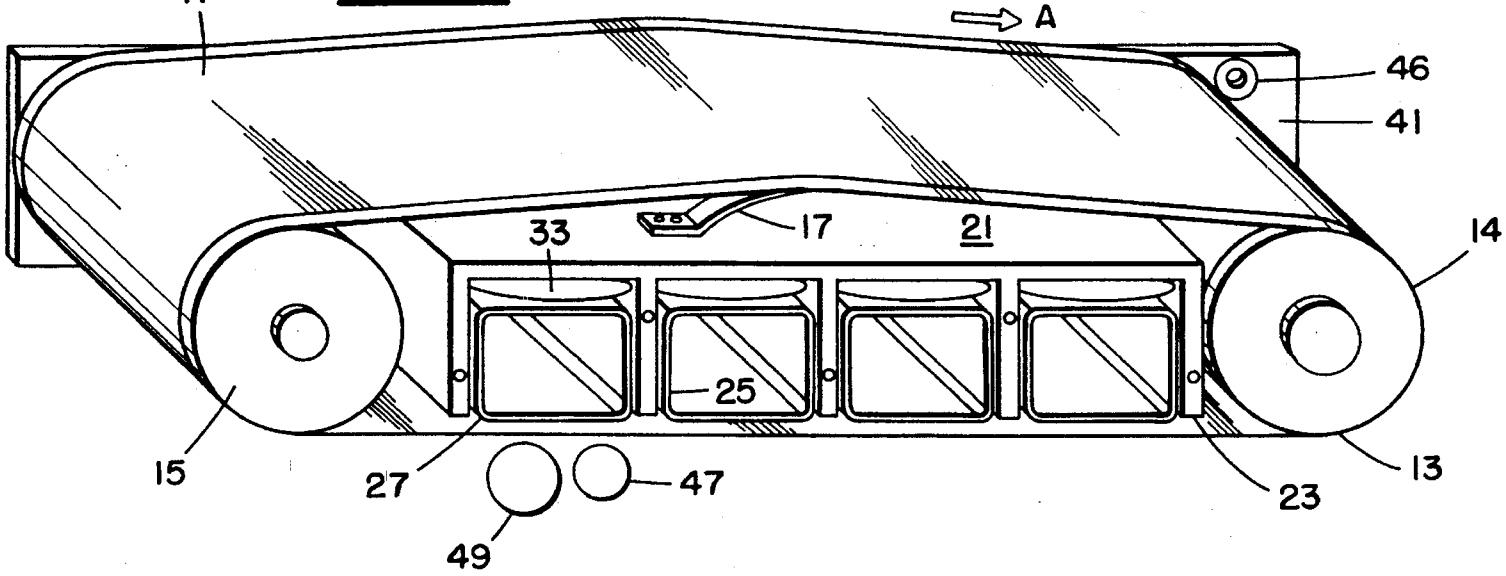
FIG. 4 is an isometric illustration of the flexible, photoconductive belt cartridge illustrating the belt displacing structure in relation to the developer and squeegee rollers.
Figure 5:
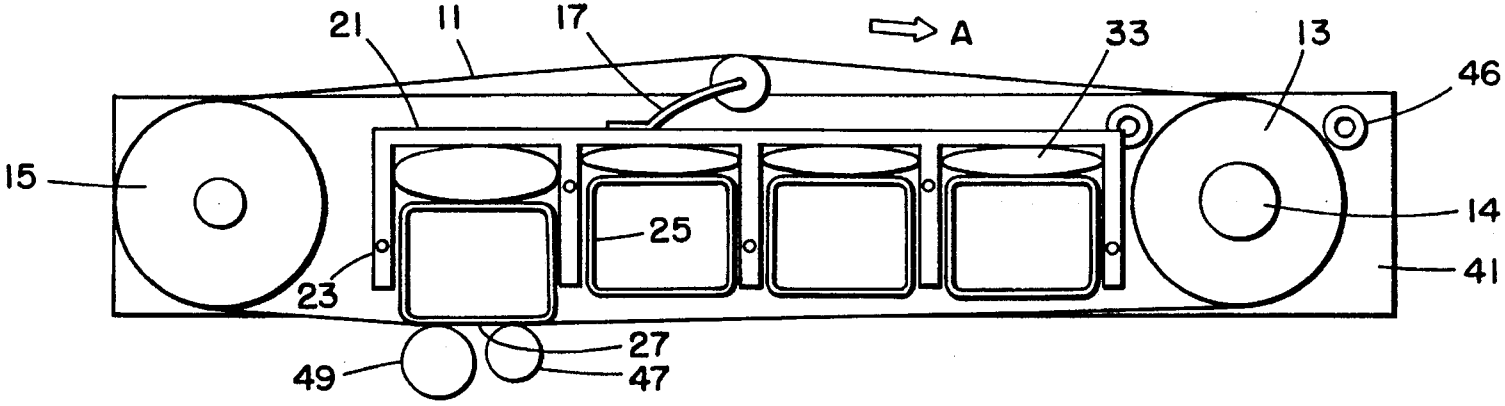
FIG. 5 is a side elevational view of FIG. 4.

The electrophotographic developers are as seen in FIG. 1. Only one set of developer rollers are shown in FIGS. 4 and 5 to demonstrate the function of the belt displacing mechanism. The roller 47 is the developer roller and the roller 49 is the squeegee roller. As in FIG. 1, the developer roller 47 transfers toner to the latent image and the squeegee roller 49 removes excess toner.

The operation of this embodiment of the present invention can be understood with reference to FIG. 5. The photoconductor surface 12 of the photoconductor belt 11, being charged in a manner as is known in the art, is exposed to form an electrostatic latent image on the photoconductor surface 12. To develop the latent image, the photoconductor belt 11, in its endless loop path "A", moves the latent image past the developer and squeegee rollers 47, 49. Using standard control technology, the developer actuation system of the present invention transfers gas from the pump 35 through rotary valve 37 to the appropriate bladder 33 in a timing sequence coordinated with the developer mechanism in the sequence in which each color toner is to be applied. As a bladder 33 fills with gas, the platen support member 25 is shifted out the open end of the U-shaped guide 19. The extended platen 27 pushes the photoconductor 11 into functional proximity with the appropriate developer roller 47 which transfers toner to develop the latent image on the moving photoconductor 11. Excess toner is then removed from the photoconductor 11 by the squeegee roller 49. When the toner transfer is complete, the bladder 33 is allowed to deflate under the influence of the tensioned photoconductor 11 or any optional biasing mechanism provided, venting the gas out through valve 39 or back into the pressurizing system. The platen support member 25 is pushed or drawn back under a bias member, retracting into the U-shaped guide 19.

In a monochrome printing mode, for example, black only for a page of text, the latent image on the photoconductor 11 can be developed on one pass of the developer actuation system, inflating the bladder 33 at the developer rollers 47, 49 where black toner is applied. In a multicolor printing mode, the photoconductor 11 may be circulated at least once for each color toner, for example, yellow, magenta, and cyan, to be applied to develop the latent image. Thus, a full color page with text may require four or more passes through the developer actuation system to develop the latent image fully before it is transferred to a hard copy medium and fixed. With toner and media designed appropriately, controls may be developed to sequence more than one platen into contact with the QPC belt during a single pass. The photoconductor surface 12 can then be cleaned and exposed to a new image.

It should be noted that the developer actuation system can be a permanent fixture or designed as a self-contained unit, as shown in FIG. 2 where the entire mechanism can be easily removed and replaced, mating with appropriate mechanical and pneumatic power mechanisms in the hard copy apparatus.

As will be apparent to a person skilled in the art, hydraulic pressure mechanisms can be substituted for the pneumatic mechanisms as disclosed. However, such would appear to be more complex and costly, while offering no significant advantages over the pneumatic embodiment described but adding the risk of hydraulic fluid leakage.

The foregoing description of the preferred embodiments of the present invention has been presented for purposes of illustration and description. The disclosure is neither intended to be exhaustive nor to limit the invention to the precise implementations disclosed. The present invention is clearly applicable to dry toner systems, as well as the liquid systems disclosed herein for teaching purposes. Variations in implementing the present invention in a dry toner or powder based system are known. Obviously, many modifications and variations will be apparent to practitioners skilled in this art. Similarly, any process steps described might be interchangeable with other steps in order to achieve the same result. The illustrated embodiments were chosen and described in order to best explain the principles of the invention and its best mode practical application, to thereby enable others skilled in the art to understand the invention for various other embodiments and with various modifications, as are suited to the particular use contemplated. It is intended that the scope of the invention be defined by the claims appended hereto and their equivalents.

What is claimed is:

1. A system for developing latent images in a flexible photoconductor, the system having a mechanism for moving said photoconductor with a latent image thereon, and at least one developer mechanism for transferring toner from a supply of toner to said flexible photoconductor, said system comprising:

shifting means, mounted adjacent said flexible photoconductor, for shifting a predetermined portion of said photoconductor at said latent image thereon from its path of motion into a position of functional proximity with respect to said developer mechanism, said shifting means including a displaceable platen means for contacting said flexible photoconductor, a guide housing for said platen means, and pressurizing means positioned between said guide housing and said platen means, said guide housing for guiding said platen means from a retracted position, when said pressurizing means is depressurized, to an extended position when said pressurizing means is pressurized, so as to position said flexible photoconductor at said functional proximity to said developer mechanism; and pressurizing means, connected to said shifting means, for supplying a pneumatically controlled force on said shifting means to cause the shifting of said predetermined portion of said flexible photoconductor.

2. The system as set forth in claim 1, wherein said pressurizing means further comprises:

a pneumatic pump;

a bladder adjoining said shifting means; and transferring means, connecting said pump to said bladder in pneumatic communication, for transferring gas from said pump to inflate said bladder.

3. The system as set forth in claim 2, including four developer mechanisms connected to multiple supplies of toner, each having a different pigmentation, said system further comprising:

a separate shifting means for each said developer mechanism, and a separate pressurizing means adjoining each said shifting means.

4. The system as set forth in claim 3, wherein said transferring means further comprises:

an accumulator for storing a predetermined supply of pressurized gas therein, connected to receive gas from said pump upstream of said bladder;

means for coupling a supply of pressurized gas to each said bladder.

5. The system as set forth in claim 1, wherein said shifting means further comprises:

biasing means for returning said platen means from said pressurized position to said depressurized position.

6. A system for developing latent images in a flexible photoconductor in an electrophotography apparatus, comprising:

pressurizing means for supplying pneumatic pressure;

a flexible photoconductor having an electrostatic latent image thereon;

driving means, connected to said flexible photoconductor, for driving said flexible photoconductor in a predetermined path;

one developer means for each different color of toner employed by said apparatus, positioned adjacent said predetermined path, for applying said toner to said latent image;

moving means, connected to said pressurizing means, for selectively moving a portion of said flexible photoconductor in a region bearing said latent image thereon into communication with each said developer means to receive preselected toner on said latent image, said moving means including platen means for contacting said flexible photoconductor, a guide housing for said platen means and an inflatable bladder mounted between said guide housing and said platen means, said bladder, when inflated, causing said platen means to move along said guide housing to position said flexible photoconductor means region bearing a latent image in functional proximity to said developer mean.

7. The system as set forth in claim 6, comprising:

a drive roller and an idler pulley frictionally coupled to said flexible photoconductor for moving said flexible photoconductor in a closed-loop path.

8. The system as set forth in claim 6, wherein said platen means further comprises:

a platen mechanism, including:

i. a base plate;

ii. a platen support member having a platen on one face thereof for contacting said photoconductor in said region bearing a latent image thereon; and iii. a flexible biasing means for connecting said platen support member to said base plate in a substantially perpendicular movable relationship, said bladder mounted between said base plate and said platen support member at a region distal from said platen, for receiving and discharging a charge of gas from said means for supplying pneumatic pressure, such that when said bladder is inflated said platen is moved perpendicularly to said base plate to position said photoconductor region bearing a latent image in functional proximity to said developer means.

9. The system as set forth in claim 6, wherein said moving means further comprises:

a release valve for selectively deflating said bladder to retract said platen means into said guide housing to enable retraction of said flexible photoconductor from said position of functional proximity with respect to said developer means.

10. The system as set forth in claim 6, wherein said moving means further comprises:

plural separate moving means, each one adjacent said flexible photoconductor in a position opposite a developer means.

11. The system as set forth in claim 9, wherein said moving means further comprises:

an accumulator, connected between said pressurizing means and said bladder, for holding a predetermined charge of gas from said pressurized means; and valve means for connecting said accumulator to said bladder.

12. The system as set forth in claim 6, wherein said moving means further comprises:

biasing means for forcibly deflating said bladder when said bladder is disconnected from said pressurizing means.

13. A color toner electrophotographic apparatus mechanism for transferring toner color from individual color reservoirs to a photoconductor, comprising:

a. a flexible closed-loop belt having a continuous region bearing a layer of photoconductive material;

b. a belt drive for moving said belt;

c. a guide device mounted within the closed-loop formed by said belt;

d. platen mechanisms, in a number corresponding to a number of color toner reservoirs utilized by said apparatus, movably mounted with respect to said guide device, each having a platen on a surface of said platen mechanisms and guided by said guide device into contact with said belt within the closed-loop while said belt drive moves said belt;

e a pneumatic subsystem, comprising:

i. a gas pump;

ii. an inflatable and deflatable device functionally mounted with respect to said guide device and said platen mechanisms and connected to said gas pump;

f. individual developer mechanisms for receiving toner from each of said color toner reservoirs, each developer mechanism being mounted adjacent said flexible belt in a position opposing each said platen mechanisms, inflation of said inflatable and deflatable device causing said platen mechanism to contact said flexible belt and to move a portion of said flexible belt so contacted toward an opposed developer mechanism for transferring toner transferred from the opposed developer mechanism to a latent image in said photoconductive material on said flexible belt.

14. A latent image developer system for an electrophotographic apparatus, comprising:

a. an elongated flexible photoconductor member having a photoconductor surface and a back surface which is opposite said photoconductor surface;

b. an electrophotographic developer device containing toner, a developer roll and a squeegee roll, said electrophotographic developer device being positioned in a non-toner transfer position relationship adjacent said photoconductor surface of said elongated flexible photoconductor member, said electrophotographic developer device transferring toner to said photoconductor surface when a toner transfer position relationship is established between said photoconductor surface and said electrophotographic developer device;

c. means for forming a latent image in said photoconductor surface;

d. means for moving said elongated flexible photoconductor member along a path to move said latent image in said photoconductor surface toward said electrophotographic developer device while maintaining said non-toner transfer position relationship, and e. means for displacing at least that portion of said elongated flexible photoconductor member which is adjacent said electrophotographic developer device from said path toward said electrophotographic developer device to position said photoconductor surface in said toner transfer position relationship with said electrophotographic developer device for transferring toner from said electrophotographic developer device to said latent image in said photoconductor surface as said latent image moves past said electrophotographic developer device, said means for displacing including a platen having a planar contact area juxtaposed to said back surface of said photoconductor member which, upon actuation, brings said photoconductor member into substantially simultaneous operative relationship with both said developer roll and said squeegee roll.

15. The latent image developer system according to claim 14, in which said means for displacing further comprises:

electromagnetic means for displacing said platen into engagement with said back surface of said elongated photoconductor member, toward said electrophotographic developer device for displacing said elongated photoconductor member from said path and placing said photoconductor surface in said toner transfer position relationship with said electrophotographic developer device.

16. The latent image developer system according to claim 14, in which said means for displacing further comprises:

a fluid operated mechanism for displacing said platen while said platen is in engagement with said back surface of said elongated photoconductor member, toward said electrophotographic developer device for displacing said elongated photoconductor member from said path and placing said photoconductor surface in said toner transfer position relationship with said electrophotographic developer device.

* * * * *